US011753848B2

(12) United States Patent
Tien

(10) Patent No.: US 11,753,848 B2
(45) Date of Patent: Sep. 12, 2023

(54) DOOR LOCK WITH REINFORCED FIREPROOF FUNCTION

(71) Applicant: I-TEK METAL MFG. CO., LTD, Tainan (TW)

(72) Inventor: Hung-Jen Tien, Tainan (TW)

(73) Assignee: I-TEK METAL MFG. CO., LTD, Tainan (TW)

( * ) Notice: Subject to any disclaimer, the term of this patent is extended or adjusted under 35 U.S.C. 154(b) by 277 days.

(21) Appl. No.: 17/184,759

(22) Filed: Feb. 25, 2021

(65) Prior Publication Data

US 2022/0235575 A1 Jul. 28, 2022

(51) Int. Cl.

| | |
|---|---|
| ***E05B 17/00*** | (2006.01) |
| ***E05B 1/00*** | (2006.01) |
| ***E05B 3/00*** | (2006.01) |
| ***E05B 15/16*** | (2006.01) |

(52) U.S. Cl.

CPC ..... *E05B 17/0075* (2013.01); *E05B 1/0053* (2013.01); *E05B 3/003* (2013.01); *E05B 15/1614* (2013.01); *E05Y 2201/484* (2013.01); *E05Y 2201/68* (2013.01); *E05Y 2600/46* (2013.01); *E05Y 2600/51* (2013.01); *E05Y 2800/416* (2013.01); *E05Y 2800/674* (2013.01)

(58) Field of Classification Search

CPC ..... E05B 17/00; E05B 17/0075; E05B 1/00; E05B 1/0053; E05B 3/00; E05B 3/003; E05B 15/00; E05B 15/16; E05B 15/1607; E05B 15/1614; E05B 15/1621; E05B 2800/00; E05B 2800/40; E05B 2800/416; E05B 2800/67; E05B 2800/674; E05Y 2201/00; E05Y 2201/47; E05Y 2201/484; E05Y 2201/486; E05Y 2201/68; E05Y 2600/40; E05Y 2600/46; E05Y 2600/51

USPC ..... 70/57

See application file for complete search history.

(56) References Cited

U.S. PATENT DOCUMENTS

2017/0275912 A1* 9/2017 Murphy ..... E05B 15/16
2017/0275921 A1* 9/2017 Murphy ..... E05B 13/005

FOREIGN PATENT DOCUMENTS

AU 2014339759 B2 * 5/2018 ..... E05B 55/00

* cited by examiner

*Primary Examiner* — Nathan Cumar

(74) *Attorney, Agent, or Firm* — Alan D. Kamrath; Karin L. Williams; Mayer & Williams PC

(57) ABSTRACT

A door lock with a reinforced fireproof effect includes a lock body mounted on a door and inner and outer operating units mounted to two sides of the door, respectively. The lock body includes inner and outer chassis made of ferrous material or stainless steel having a melting point higher than 1300° C. Inner and outer fixing members coupled with the inner and outer chassis are also made of ferrous material or stainless steel. Thus, these components of the door lock are less likely to melt during a fire, reducing the spreading speed of the fire.

5 Claims, 9 Drawing Sheets

DOOR LOCK WITH REINFORCED FIREPROOF FUNCTION

BACKGROUND OF THE INVENTION

The present invention relates to a door lock and, more particularly, to a door lock mounted in a hole of a door and capable of delaying spread of fire through the hole during a fire that melt the door lock.

To install a lock on a door for keeping the door in a closed state, the door is drilled to form a through-hole extending from a side of the door through the other side of the door. A door lock generally includes a lock body and a latch device operatively connected to the lock body. The door lock further includes an inner operating unit and an outer operating unit. After the door lock, the latch device, and the inner and outer operating units are mounted on the door, the through-hole of the door is closed.

In consideration of the processing and costs, the components of door locks are generally made by casting or pressing. In either way, metals (such as zinc, copper, aluminum, magnesium, lead, or tin) of a low melting point or alloys thereof are used to permit easy heating to a fluidic form. As an example, the door locks are generally made of zinc alloys having a melting point of about 385° C. When a fire occurs, the lock body melts quickly under the high temperature at the fire site, and the door lock cannot seal the through-hole of the door when the lock body melts even if the door is fireproof. Thus, fire can spread from a side (such as the outer side) to the other side (such as the inner side) of the door. As a result, traditional door locks provide a poor effect in postponing spread of fire.

BRIEF SUMMARY OF THE INVENTION

In view of the above drawbacks, the present invention provides a door lock with reinforced fireproof function. The door lock comprises:

an inner chassis made of ferrous material or stainless steel, wherein the inner chassis includes a first groove formed on an outer periphery thereof;

an inner mounting seat coupled to the inner chassis and including a second groove aligned with the first groove along an axis parallel to a longitudinal axis of the inner chassis;

an outer chassis made of ferrous material or stainless steel;

an outer mounting seat coupled to the outer chassis, wherein the outer mounting seat includes an opening aligned with the first and second grooves along the axis parallel to the longitudinal axis of the inner chassis, wherein the outer mounting seat is coupled to the inner mounting seat, wherein the inner and outer mounting seats are configured to be received in a first through-hole of a door, and wherein the inner and outer chassis are at inner and outer sides of the door;

a retractor movably received between the inner and outer mounting seats, wherein the retractor includes an engaging portion received in the opening, wherein the engaging portion is operatively connected to a latch device;

an inner fixing member made of ferrous material or stainless steel and coupled to the inner chassis, wherein the inner fixing member is configured to be fixed to the inner side of the door;

an outer fixing member made of ferrous material or stainless steel and coupled to the outer chassis, wherein the outer fixing member is configured to be fixed to the outer side of the door and closes the first through-hole;

an inner operating unit coupled to the inner fixing member and including an inner handle operatively connected to the retractor; and an outer operating unit coupled to the outer fixing member and including an outer handle operatively connected to the retractor.

After the door lock according to the present invention is mounted to the door, even if many components melt under the high temperature (such as below 1300° C.) of the fire site, the inner and outer chassis together with the inner and outer fixing members can still close the first through-hole to make the flame or smoke difficult to spread from a side to the other side of the door, slowing down the spread of fire.

In an example, the door lock further comprises an outer spindle including an outer driving lug. The outer chassis includes a first outer end face and a first outer axial hole extending from the first outer end face. The outer chassis further includes an outer chamber extending from another end face of the outer chassis to the first outer axial hole. The outer spindle is pivotably received in the first outer axial hole. The outer driving lug is operatively connected to the retractor. The outer mounting seat includes a second outer end face connected to the first outer end face of the outer chassis. An outer torsion spring is received in the outer chamber and configured to bias the outer spindle. An inner spindle includes an inner driving lug. The inner chassis includes a first inner end face and a first inner axial hole extending from the first inner end face. The inner chassis further includes an inner chamber extending from another end face of the inner chassis to the first inner axial hole. The inner spindle is pivotably received in the first inner axial hole. The inner driving lug is operatively connected to the retractor. The inner mounting seat includes a second inner end face connected to the first inner end face of the inner chassis. An inner torsion spring is received in the inner chamber and configured to bias the inner spindle.

In an example, the door lock further comprises a locking control device received in the inner spindle. The locking control device includes a control arm movable along a longitudinal axis of the inner spindle. The first outer axial hole includes an inner periphery having a limiting groove. The outer mounting seat further includes an outer movement groove extending from the second outer end face along a longitudinal axis of the first outer axial hole. The outer spindle and the control arm are coupled to pivot jointly. When the control arm is in the limiting groove, the outer handle is prevented from pivoting. When the control arm is in the outer movement groove, the outer handle is permitted to pivot.

In an example, the door lock further comprises two mounting posts, two bolts, and a cover. The two mounting posts are connected to the outer fixing member and face the inner fixing member. The two mounting posts are configured to be received in two connecting holes in the door. The two bolts abut the inner fixing member and engage with the two mounting posts. The cover is made of ferrous material or stainless material. The cover is coupled to and abuts a face of the inner fixing member. The cover includes an insertion portion that closes the first groove.

In an example, the inner mounting seat and the outer mounting seat are made of a zinc alloy or an aluminum alloy.

In an example, the door lock further comprises a cover made of ferrous material or stainless material. The cover is coupled to and abuts a face of the inner fixing member. The cover includes an insertion portion that closes the first groove.

The present invention will become clearer in light of the following detailed description of illustrative embodiments of this invention described in connection with the drawings.

Figure 1:
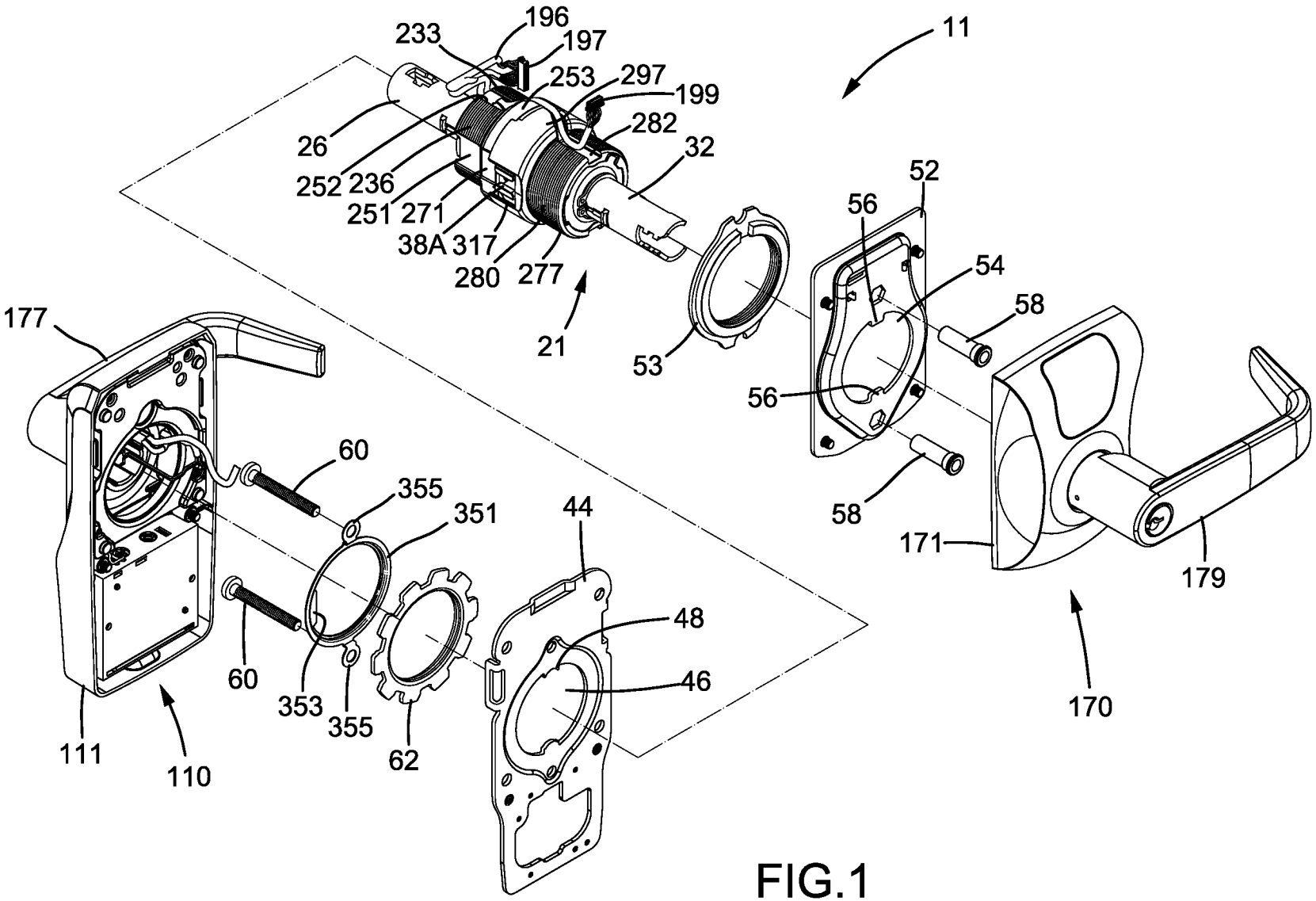
FIG. 1 is an exploded, perspective view of a door lock of an embodiment according to the present invention.
Figure 2:
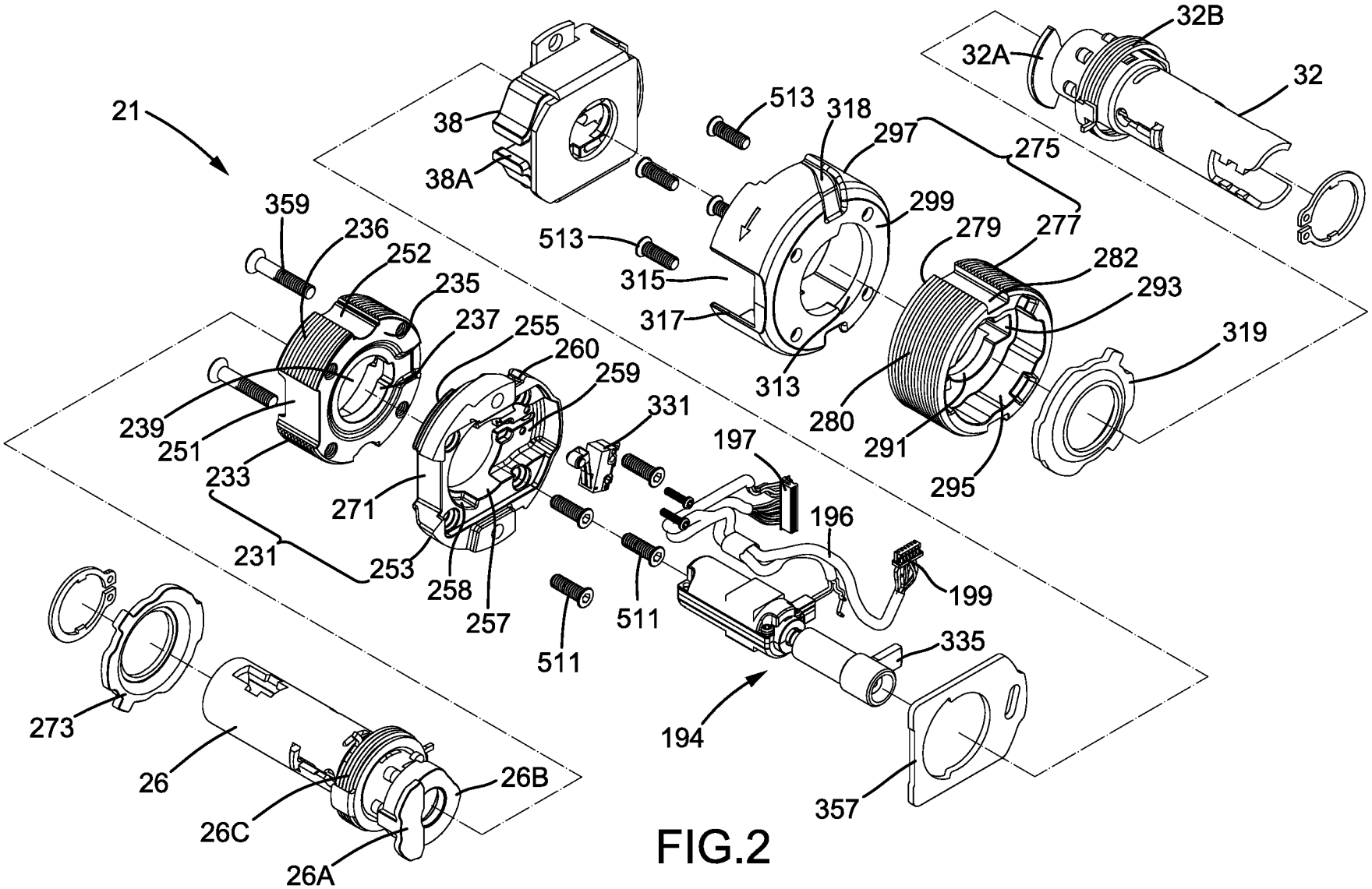
FIG. 2 is an exploded, perspective view of a lock body of the door lock of FIG. 1.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "longitudinal", "axial", "radial", "circumferential", "annular", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 3:
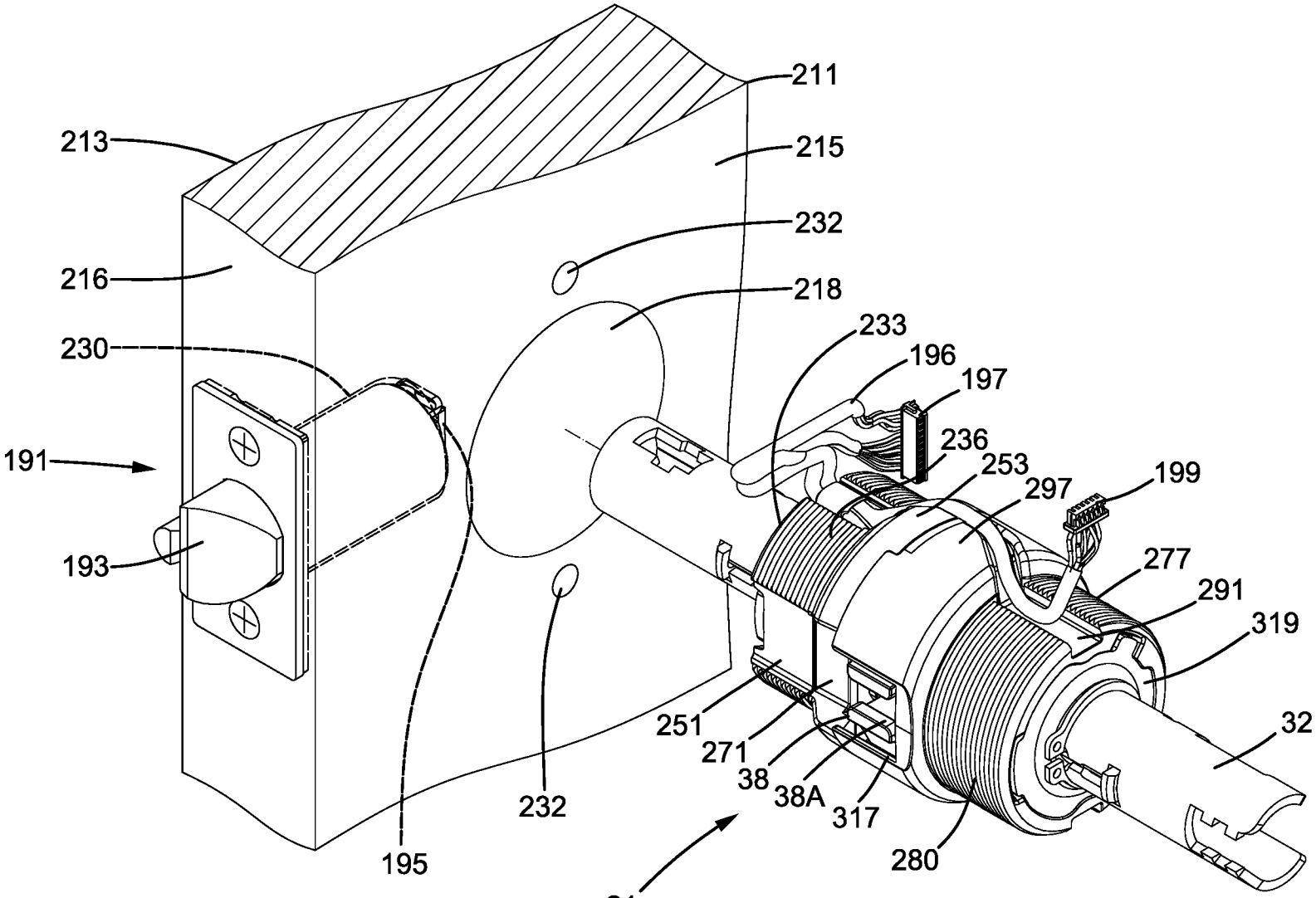
FIG. 3 is a diagrammatic view illustrating installation of the door lock of FIG. 1 on a door.
Figure 4:
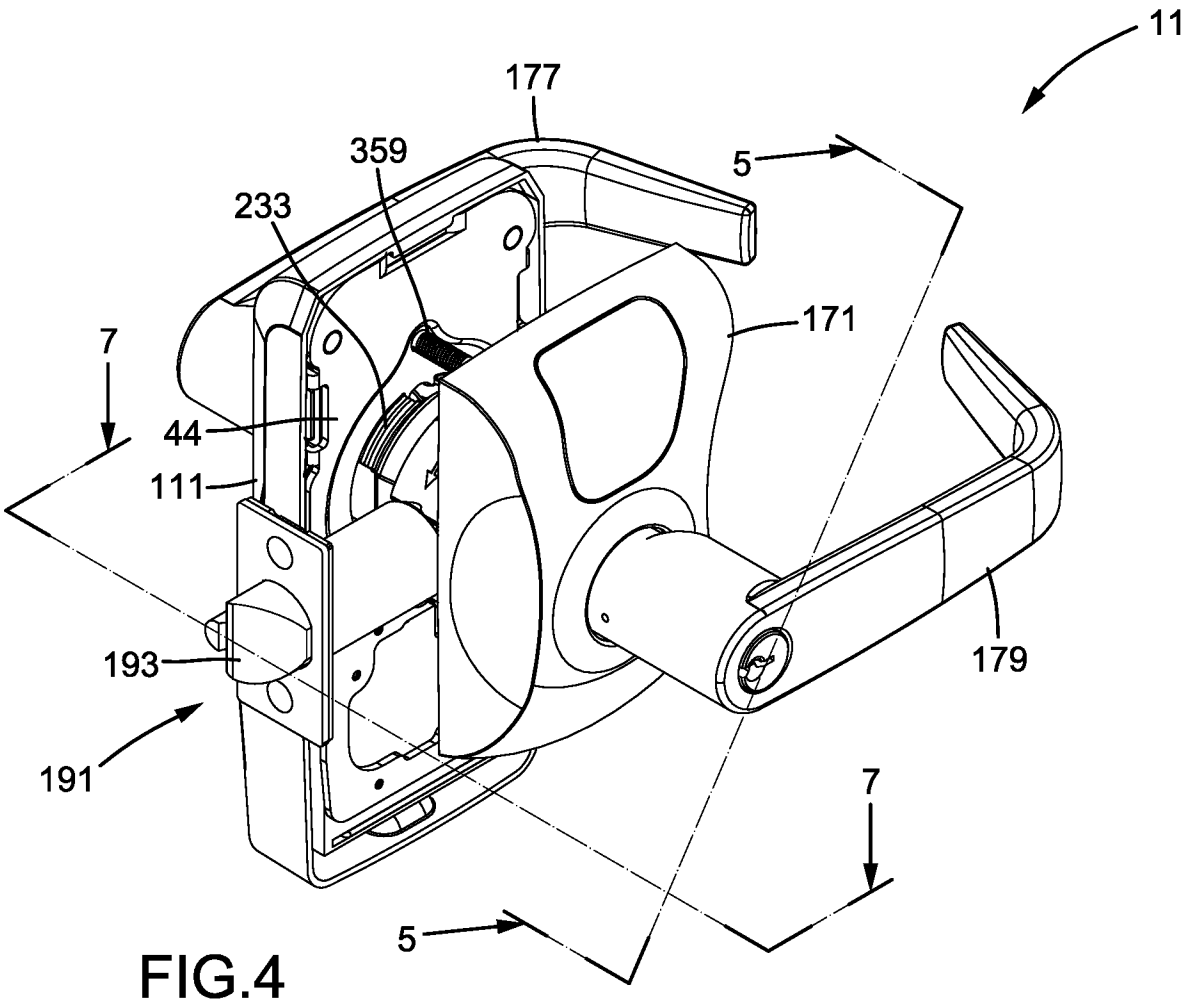
FIG. 4 sis a perspective view of the door lock of FIG. 1 after assembly.
Figure 5:
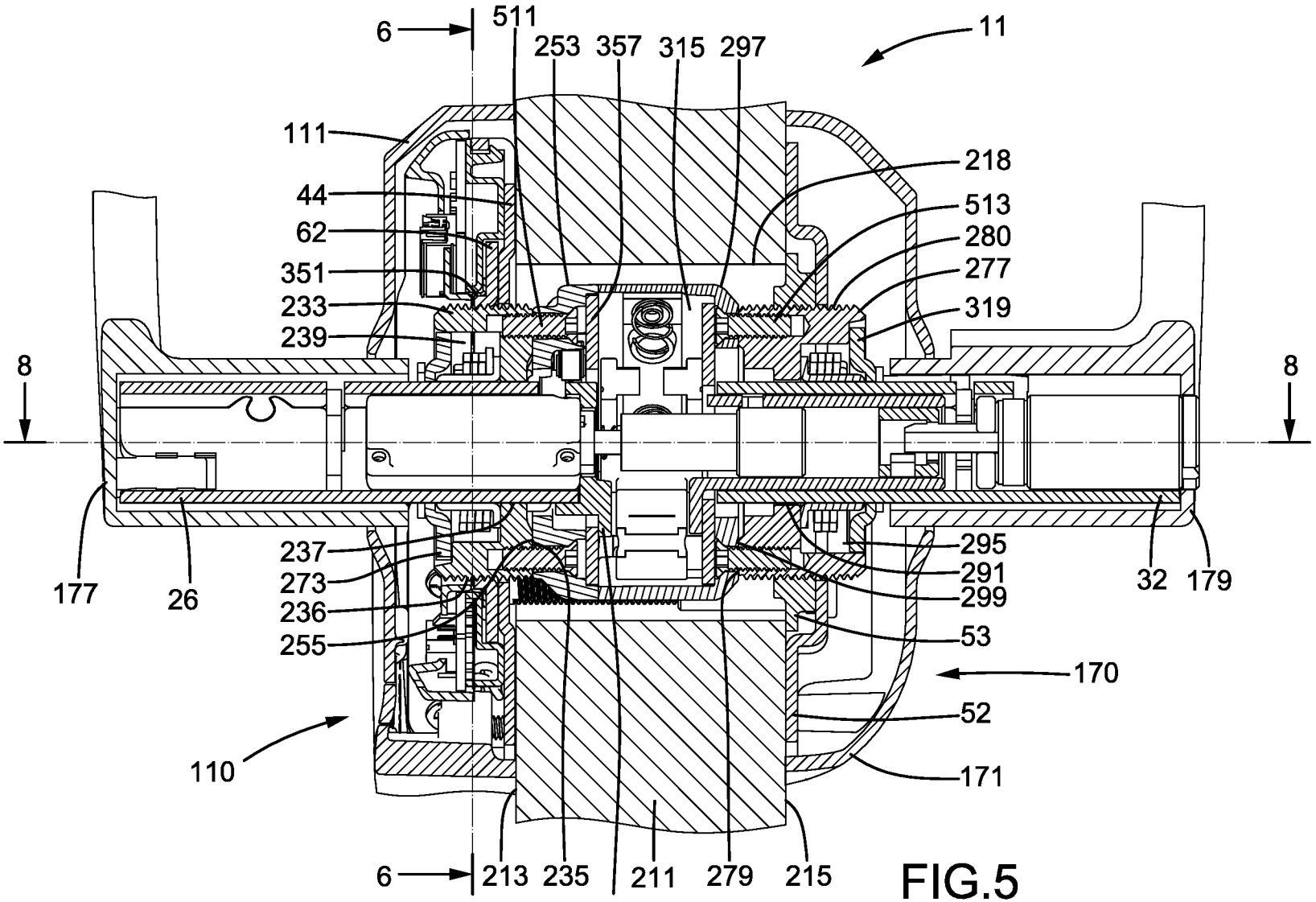
FIG. 5 is a cross sectional view taken along section line 5-5 of FIG. 4.
Figure 7:
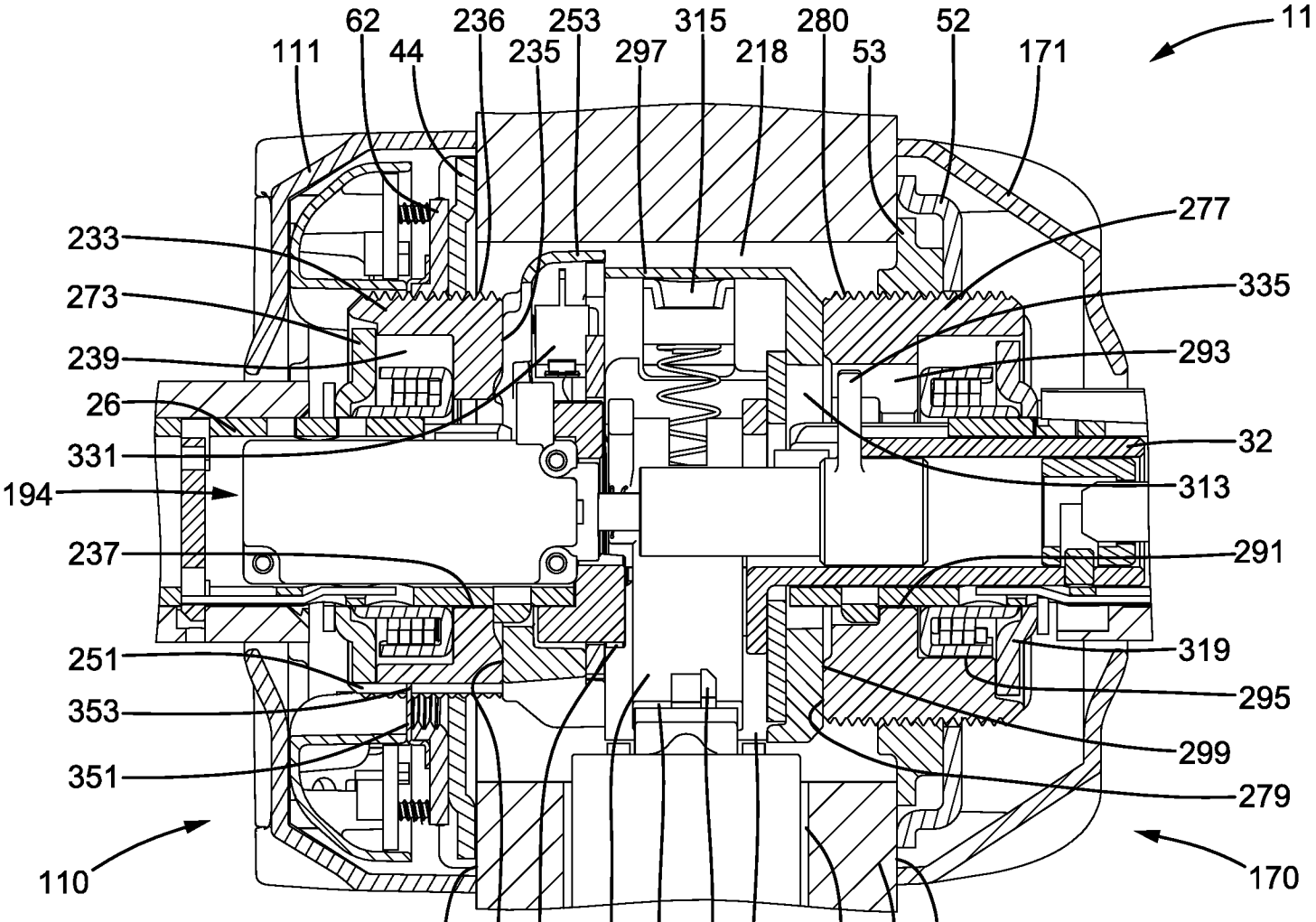
FIG. 7 is a cross sectional view taken along section line 7-7 of FIG. 4.

The present invention relates to a door lock with reinforced fireproof function. Specifically, when some components of the door lock melt in a high-temperature environment caused by a fire, the flame is not apt to spread from a side of the door through gaps between the door and the door lock to the other side of the door. The door lock 11 is mounted on a door 211 (FIGS. 5 and 7). With reference to FIG. 3, the door 211 includes an inner side 213, an outer side 215, and an end face 216 extending between the inner side 213 and the outer side 215. The door 211 further includes a first through-hole 218 extending from the inner side 213 through the outer side 215. The door 211 further includes two connecting holes 232 around the through-hole 218. The door 211 further includes a second through-hole 230 extending from the end face 218 to the first through-hole 218.

With reference to FIGS. 1-8, the door lock 11 comprises a lock body 21 having an inner portion 231 and an outer portion 275 coupled to the inner portion 231. The inner portion 231 includes an inner chassis 233 and an inner mounting seat 253 coupled to the inner chassis 233. The inner chassis 233 is made of ferrous material having a melting point higher than 1300° C. or stainless steel material having a melting point of about 1400° C. In an example, the inner chassis 233 is made of iron powders (having a melting point of about 1538° C.) formed by powder metallurgy, and the inner mounting seat 253 is made of a zinc alloy (having a melting point of about 385° C.) or an aluminum alloy (having a melting point of about 660° C.) formed by casting.

The inner chassis 233 includes a first inner end face 235 and a first inner axial hole 237 extending from the first inner end face 235. The inner chassis 233 further includes an inner chamber 239 extending from another end face of the inner chassis 233 to the first inner axial hole 237. An outer periphery of the inner chassis 233 further includes a first outer threading 236, a first groove 251 severing the first outer threading 236, and two first inner recessed portions 252 severing the first outer threading 236. The first groove 251 is located between the two first inner recessed portions 252 in a circumferential direction about a longitudinal axis of the first inner axial hole 237. Each of the first groove 251 and the two first inner recessed portions 252 extends from the first inner end face 235 to the other end face of the inner chassis 233 in a direction parallel to the longitudinal axis of the first inner axial hole 237.

The inner mounting seat 253 includes a second inner end face 255 and a second inner axial hole 259 extending from the second inner end face 255 along the longitudinal axis of the first inner axial hole 237. The second inner axial hole 257 includes an inner periphery having an inner movement groove 258 that is arcuate. The inner mounting seat 253 further includes an installation space 259 extending from another end face of the inner mounting seat 253 to the second inner axial hole 257. The inner mounting seat 253 further includes two second inner recessed portions 260 connected to the two first inner recessed portions 252 and a second groove 271.

The first inner end face 235 of the inner chassis 233 is connected to the second inner end face 255 of the inner mounting seat 253, and the first inner axial hole 237 is coincident with the second inner axial hole 257. In an example, four inner screws 511 extend through the inner mounting seat 253 to be in treading connection with the inner chassis 233. After the four inner screws 511 are tightened, the first inner end face 235 tightly presses against the second inner end face 255 (see FIG. 5). Thus, the inner chassis 233 are assembled with the inner mounting seat 253 as an integral member. The two first inner recessed portions 252 are contiguous to and in alignment with the two second recessed portions 260. The first groove 251 is contiguous to and in alignment with the second groove 271.

The outer portion 275 includes outer chassis 277 and an outer mounting seat 297 coupled to the outer chassis 277. The outer chassis 277 is made of ferrous material having a melting point higher than 1300° C. or stainless steel material having a melting point of about 1400° C. In an example, the outer chassis 277 is made of iron powders (having a melting point of about 1538° C.) formed by powder metallurgy, and the outer mounting seat 297 is made of a zinc alloy (having a melting point of about 385° C.) or an aluminum alloy (having a melting point of about 660° C.) formed by casting.

The outer chassis 277 includes a first outer end face 279 and a first outer axial hole 291 extending from the first outer end face 279. The outer chassis 277 further includes an outer chamber 295 extending from another end face of the outer chassis 277 to the first outer axial hole 291 (see FIG. 2). An outer periphery of the outer chassis 277 includes a second outer threading 280 and two first outer recessed portions 282 severing the second outer threading 280. Each of the two first outer recessed portions 282 extends from the first outer end face 279 to the other end face of the outer chassis 277 in a direction parallel to the longitudinal axis of the first outer axial hole 291.

The outer mounting seat 297 includes a second outer end face 299 and an outer movement groove 313 extending from the second outer end face 299 along a longitudinal axis of the first outer axial hole 291. The outer chassis 297 further includes a movement space 315 extending from the other end face of the outer chassis 297 and in association with the inner movement groove 258. The outer mounting seat 297 further includes an opening 317 extending from an outer periphery thereof to the movement space 315. The outer periphery of the outer mounting seat 297 further includes two second outer recessed portions 318 connected to the two first outer recessed portions 282.

The first outer end face 279 of the outer chassis 277 is connected to the second outer end face 299 of the outer mounting seat 297, and the first outer axial hole 291 is coincident with the outer movement groove 313. In an example, four outer screws 513 extend through the outer mounting seat 297 to be in threading connection with the outer chassis 277. After the four outer screws 513 are tightened, the outer chassis 277 and the outer mounting seat 297 are assembled together as an integral member. The two first outer recessed portions 282 are contiguous to and in alignment with the two second outer recessed portions 318.

The inner mounting seat 253 of the inner portion 231 and the outer mounting portion 297 of the outer portion 275 are coupled with each other. Two screws 359 extend through the inner mounting seat 253 to be in threading connection with the outer mounting seat 297 (see FIG. 8). Thus, the inner portion 231 and the outer portion 275 are coupled together as an integral member. Furthermore, the opening 317 of the outer mounting seat 297 is aligned with the first and second grooves 251 and 271 along an axis parallel to the longitudinal axis of the first inner axial hole 237 of the inner chassis 233 (see FIG. 1). A retractor 38 and a sensor 331 are movably received in the installation space 259 of the inner mounting seat 253 and the movement space 315 of the outer mounting seat 297. The retractor 38 includes a front end having an engaging portion 38A. The retractor 38 is biased by a plurality of springs to an initial position in which the engaging portion 38A is in the opening 317 (see FIGS. 3 and 7). The engaging portion 38A is aligned with the first and second grooves 251 and 271 along the axis parallel to the longitudinal axis of the first inner axial hole 237. The sensor 331 is received in the inner movement groove 258 of the inner mounting seat 253. Specifically, the sensor 331 is located between the inner mounting seat 253 and the retractor 38 (see FIG. 7). Furthermore, a side cover 357 is disposed to the inner mounting seat 253 and is located between the sensor 331 and an inner driving lug 26A of an inner spindle 26 of the lock body 21 along the longitudinal axis of the inner spindle 26.

The inner spindle 26 of the lock body 21 is pivotably connected to the inner portion 231. The lock body 21 further includes an outer spindle 32 pivotably connected to the outer portion 275. The inner driving lug 26A of the inner spindle 26 is operatively connected to the retractor 38. The inner spindle 26 further includes an actuating portion 26B adjacent to the sensor 331. When the inner spindle 26 pivots, the actuating portion 26B can actuate the sensor 331. An inner torsion spring 26C is disposed between the inner spindle 26 and the inner chassis 233. The inner torsion spring 26C is received in the inner chamber 239 of the inner chassis 233 and biases the inner spindle 26, such that the inner driving lug 26A is in a position in which the engaging portion 38A of the retractor 38 can be returned by the plurality of springs to its original position inside the opening 317 of the outer mounting seat 297 (see FIG. 7).

The outer spindle 32 includes an end having an outer driving lug 32A operatively connected to the retractor 38. An outer torsion spring 32B is disposed between the outer spindle 32 and the outer chassis 277. The outer torsion spring 32B is received in the outer chamber 295 of the outer chassis 277 and biases the outer spindle 32, such that the outer driving lug 32A is in a position in which the engaging portion 38A of the retractor 38 can be returned by the plurality of springs to its original position inside the opening 317 of the outer mounting seat 297 (see FIG. 7).

With reference to FIGS. 3 and 7, the lock body 21 includes a locking control device 194 received in the inner spindle 26. The locking control device 194 includes a control arm 335 pivotably received in the outer spindle 32 and a cable 196. A first connector 197 and a second connector 199 are disposed on two ends of the cable 196. The cable 196 is electrically connected to a motor (not shown) in the locking control device 194. The control arm 335 pivots when the outer spindle 32 pivots. The locking control device 194 is configured to driving the control arm 335 to move along a longitudinal axis of the inner spindle 26. When the control arm 335 is in the limiting groove 293 of the outer chassis 277, the control arm 335 cannot pivot in the limiting groove 293, and the outer spindle 32 is prevented from pivoting (see FIG. 7). Thus, the door lock 11 is in a locking state. On the other hand, when the control arm 335 moves to the outer movement groove 313 of the outer mounting seat 297, the control arm 335 can pivot in the outer movement groove 313, such that the door lock 11 is in an unlocked state (not shown). Furthermore, an outer end cap 319 is disposed to the outer chassis 277 to close the outer chamber 295, and an inner end cap 273 is disposed to the inner chassis 233 to close the inner chamber 239.

The door lock 11 further includes a separate latch device 191 operatively connected to the lock body 21. The latch device 191 includes a retractable latch 193 and a hook 195 for actuating the latch 193. The latch device 191 is placed into the second through-hole 230 via the end face 216 of the door 211. The hook 195 is received in the first through-hole 218. The latch 193 is located outside of the end face 216 of the door 211. The latch device 191 can be directly fixed to the end face 216 by screws. After the latch device 191 is fixed, the lock body 21 is placed into the first through-hole 218. Provision of the first and second grooves 251 and 271 of the inner portion 231 avoid interference of the hook 21 while placing the lock body 21 into the first through-hole 218. Furthermore, the opening 317 allows the hook 195 to extend into the outer mounting seat 297 to operatively connect with the engaging portion 38A of the retractor 38 (see FIGS. 3 and 7). Furthermore, when the engaging portion 38A of the retractor 38 is operatively connected to the hook 195 of the latch device 191, the inner mounting seat 253 and the outer mounting seat 297 are received in the first through-hole 218 and are located between the inner end face 213 and the outer end face 215 along the longitudinal axis of the first through-hole 218. An end of the inner chassis 233 is outside of the inner end face 213, and an end of the outer chassis 277 is outside of the outer end face 215.

Figure 6:
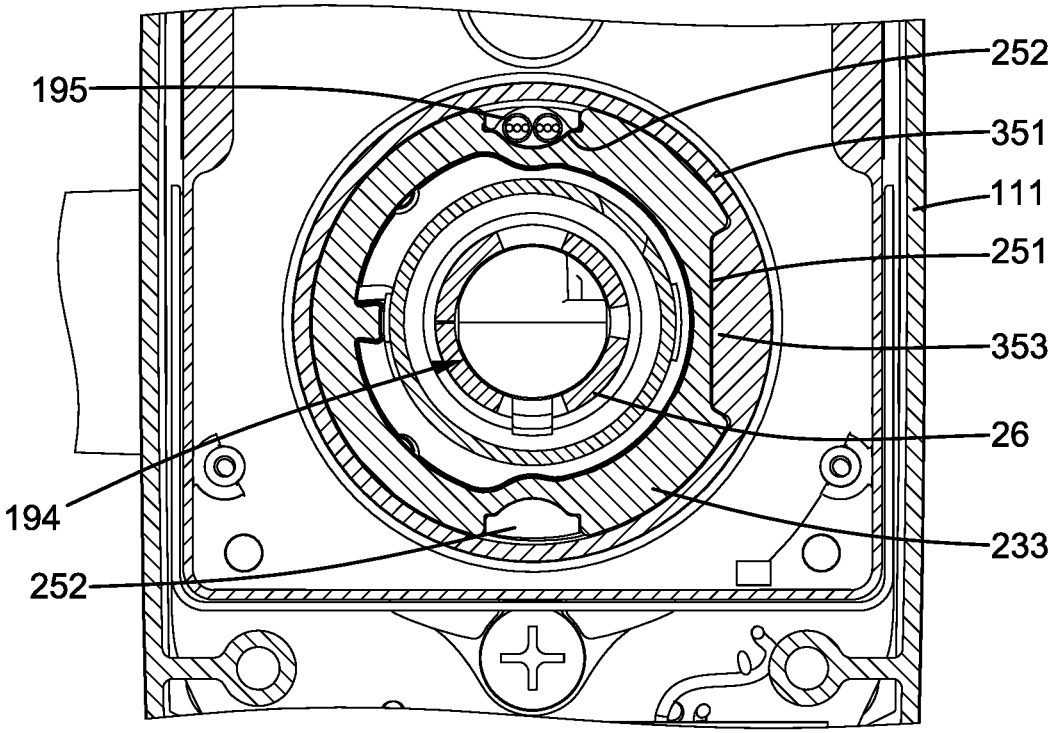
FIG. 6 is a cross sectional view taken along section line 6-6 of FIG. 5.
Figure 8:
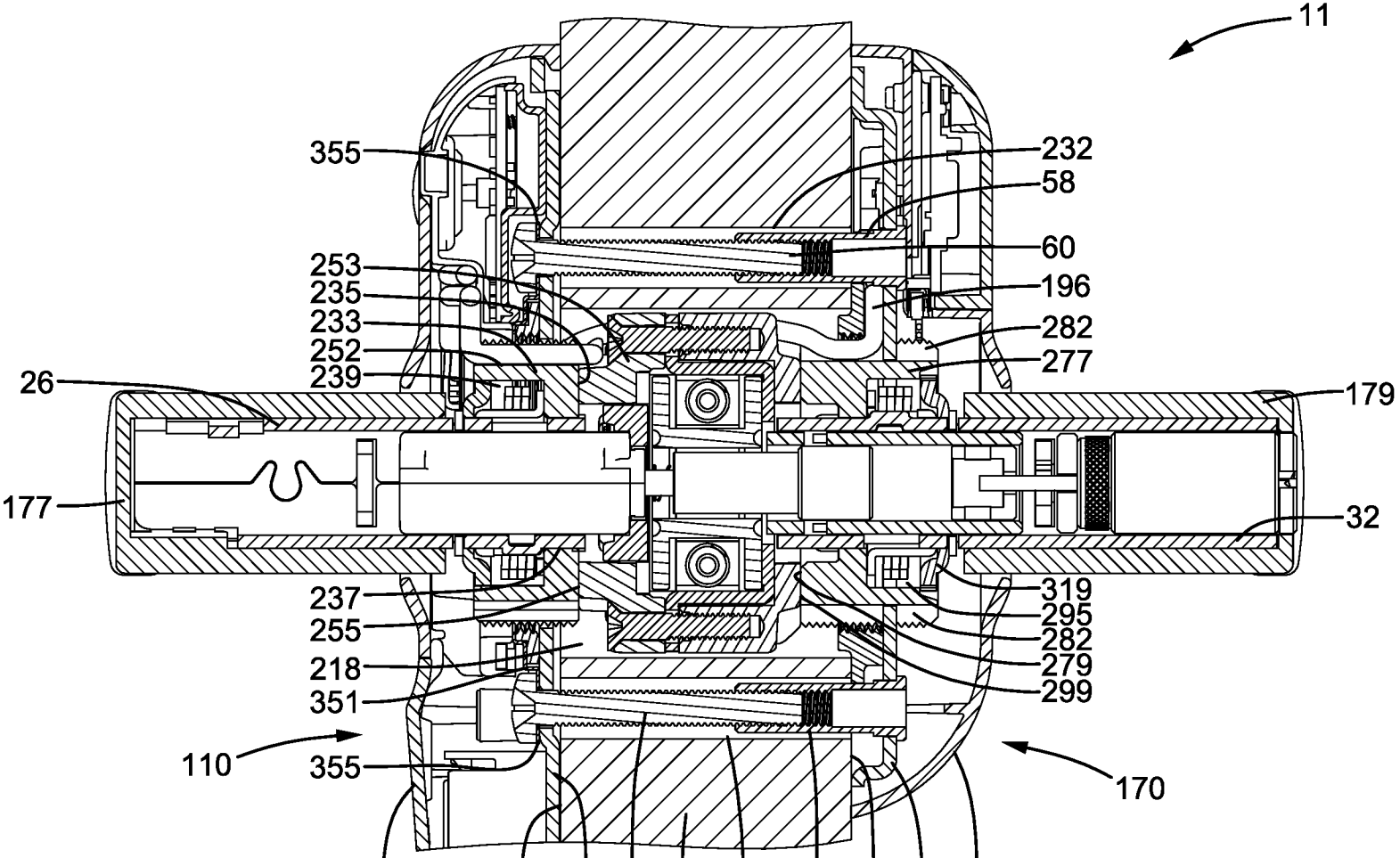
FIG. 8 is a cross sectional view taken along section line 8-8 of FIG. 5.

With reference to FIGS. 1, 6, and 8, the door lock 11 further comprises an outer operating unit 170 having an outer fixing member 52, two mounting posts 58, and an outer pressing ring 53. The outer fixing member 52 is made of ferrous material having a melting point of about 1538° C. or stainless steel material having a melting point of about 1400° C. The outer fixing member 52 includes an engaging hole 54 in association with the outer chassis 277. Two teeth 56 are formed on an inner periphery of the engaging hole 54 and are in association with the two first outer recessed portions 282. The outer pressing ring 53 is made of ferrous material having a melting point of about 1538° C. or stainless steel material having a melting point of about 1400° C. The outer pressing ring 53 includes an inner threading in threading connection with the second outer threading 280 of the outer chassis 277. The engaging hole 54 of the outer fixing member 52 engages with the outer chassis 277. The two teeth 56 engage with the two outer recessed portions 282. Thus, the outer fixing member 52 cannot rotate relative to the outer chassis 277. Furthermore, the outer fixing member 52 abuts the outer side 215 of the door 211. The two mounting posts 58 are coupled to the outer fixing member 52 and extend through the two connecting holes 232 of the door 211. The outer pressing ring 53 is threadedly coupled to the outer chassis 277 and abuts the outer side 215 of the door 211. According to the form shown, the outer pressing ring 53 is located between the outer chassis 297 and the outer fixing member 52 along the longitudinal axis of the outer spindle 32.

The outer operating unit 170 further includes an outer casing 171 and an outer handle 179. The outer casing 171 is coupled with the outer fixing member 52. The outer handle 179 is pivotably received in the outer casing 171 and is jointly pivotable with the outer spindle 32. Thus, the outer handle 179 can be operated to pivot the outer spindle 32 for retracting the latch 193 to thereby achieve unlatching. Furthermore, when the control arm 335 is in the limiting groove 293 of the outer chassis 277, the outer spindle 32 cannot be pivoted by turning the outer handle 179, such that the latch 193 remains in the extended, latching state. An electronic input device (such as Blue tooth reading device, RFID device, a keypad, etc.) can be disposed in the outer casing 171 and is electrically connected to the second connector 199. According to the form shown, a portion of the cable 196 of the locking control device 194 is received in the first and second outer recessed portions 282 and 318 of the outer portion 275. The cable 196 extends through the outer pressing ring 53 and is electrically connected to the electronic input device in the outer casing 171.

The door lock 11 further comprises an inner operating unit 110 having an inner fixing member 44, an inner pressing ring 62, and a cover 351. The inner fixing member 44 is made of ferrous material having a melting point of about 1538° C. or stainless steel material having a melting point of about 1400° C. The inner fixing member 44 includes a coupling hole 46 in association with the inner chassis 233. Two protrusions 48 are formed on an inner periphery of the coupling hole 46 and are coupled with the two first inner recessed portions 252, such that the inner chassis 233 cannot rotate relative to the inner fixing member 44. The inner fixing member 44 abuts the inner side 213 of the door 211. The inner pressing ring 62 is made of ferrous material having a melting point of about 1538° C. or stainless steel material having a melting point of about 1400° C. The inner pressing ring 62 includes an inner threading in threading connection with the first outer threading 236 of the inner chassis 233. The inner pressing ring 62 is threadedly coupled with the inner chassis 233 and abuts a face of the inner fixing member 44. The inner and outer pressing rings 62 and 53 are used to secure the position of the lock body 21 relative to the door 211 along the longitudinal axis of the first through-hole 218.

The cover 351 is made of ferrous material having a melting point of about 1538° C. or stainless steel material having a melting point of about 1400° C. The cover 351 is annular to surround the outer chassis 277. The cover 351 includes two ears 355 on an outer periphery thereof. The cover 355 further includes an inner periphery having an insertion portion 353 in association with the first groove 251. The cover 355 is mounted around the outer chassis 277, and the insertion portion 353 is coupled with the first groove 252 (see FIGS. 6 and 7). Furthermore, two bolts 60 extend through the two ears 355 and the inner fixing member 44 to threadedly couple with the two mounting posts 58.

The inner operating unit 110 further includes an inner casing 111 and an inner handle 177. The inner casing 111 is coupled to the inner fixing member 44. The inner handle 177 is pivotably received in the inner casing 111 and is jointly pivotable with the inner spindle 26. Thus, the inner handle 177 can be operated to pivot the inner spindle 26 for retracting the latch 193 of the latch device 191 for unlatching. Furthermore, the control arm 335 of the locking control device 194 is not connected to the inner spindle 26, such that the inner handle 177 can be operated no matter the control arm 335 is in the limiting groove 293 or the outer movement groove 313. A microcomputer is disposed in the inner casing 111 for controlling the electric input device and the locking control device 194 and is electrically connected to the first connector 197. According to the form shown, another portion of the cable 196 is received in the first and second inner recessed portions 252 and 260 of the inner portion 231, and the cable 196 extends through the inner pressing ring 62 to be electrically connected to the microcomputer of the inner casing 111.

Figure 9:
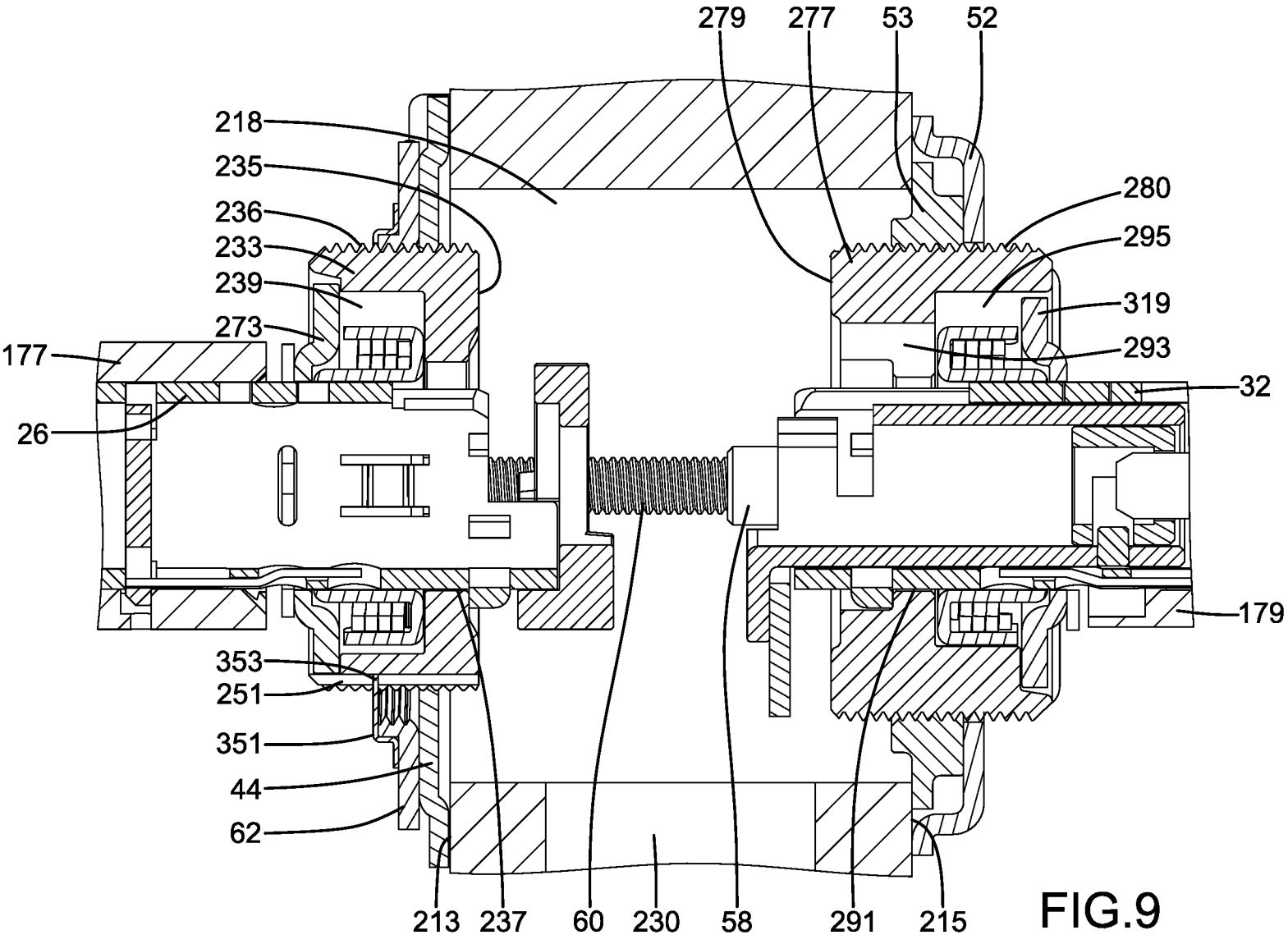
FIG. 9 is a diagrammatic cross sectional view of the door lock after melting under high temperature.

With reference to FIG. 9, assuming that a fire occurs at the outer side of the door 211, since the inner and outer fixing members 44 and 52, the inner and outer pressing ring 62 and 53, the cover 351, and the inner and outer chassis 233 and 277 are made of ferrous or stainless material having a melting point higher than 1300° C., when the temperature at the fire site is lower than 1300° C. (such as 1200° C.), these components will not melt or burn out while the inner and outer casings 111 and 171 and other components in the inner and outer mounting seats 253 and 297 melt or burn out under the high temperature caused by the fire. Thus, the first through-hole 218 of the door 211 is still closed by the above components made of ferrous or stainless steel. As a result, spreading of the flame from the outer side through the through-hole 218 to the inner side of the door 211 or vice versa is impeded, slowing down the spread of fire.

With reference to FIGS. 6 and 9, it is noted that the insertion portion 353 of the cover 351 closes the first groove 251, such that the flame or smoke of the fire is not apt to spread along the first and second grooves 251 and 271 of the inner side 231.

After the door lock 11 according to the present invention is mounted to the door 11, even if many components melt under the high temperature (such as below 1300° C.) of the fire site, the inner and outer chassis 233 and 277 together with the inner and outer fixing members 44 and 52 can still close the first through-hole 218 to make the flame or smoke difficult to spread from a side to the other side of the door 211, slowing down the spread of fire.

The insertion portion 353 of the cover 351 closes the gaps between the first and second grooves 251 and 271 and the first through-hole 218 of the door 211, making the flame or smoke more difficult to spread from a side to the other side of the door 211, slowing down the spread of fire.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A door lock comprising:

an inner chassis made of ferrous material or stainless steel, wherein the inner chassis includes a first groove formed on an outer periphery thereof, an inner mounting seat coupled to the inner chassis and including a second groove aligned with the first groove along an axis parallel to a longitudinal axis of the inner chassis;

an outer chassis made of ferrous material or stainless steel;

an outer mounting seat coupled to the outer chassis, wherein the outer mounting seat includes an opening aligned with the first and second grooves along the axis parallel to the longitudinal axis of the inner chassis, wherein the outer mounting seat is coupled to the inner mounting seat, wherein the inner and outer mounting seats are configured to be received in a first through-hole of a door, and wherein the inner and outer chassis are respectively at an inner side and an outer side of the door, with the first through-hole of the door extending from the inner side through the outer side of the door;

a retractor movably received between the inner and outer mounting seats, wherein the retractor includes an engaging portion received in the opening, wherein the engaging portion is operatively connected to a latch device;

an inner fixing member made of ferrous material or stainless steel and coupled to the inner chassis, wherein the inner fixing member is configured to be fixed to the inner side of the door;

an outer fixing member made of ferrous material or stainless steel and coupled to the outer chassis, wherein the outer fixing member is configured to be fixed to the outer side of the door and closes the first through-hole;

an inner operating unit coupled to the inner fixing member and including an inner handle operatively connected to the retractor;

an outer operating unit coupled to the outer fixing member and including an outer handle operatively connected to the retractor; and a cover made of ferrous material or stainless material, wherein the cover is coupled to and abuts a face of the inner fixing member, and wherein the cover includes an insertion portion that closes the first groove, wherein melting points of the inner chassis, the outer chassis, the inner fixing member, the outer fixing member, and the cover are higher than melting points of remaining components of the door lock, wherein when the remaining components of the door lock melt under a fire occurred at one of the inner and outer sides of the door, the inner chassis, the outer chassis, the inner fixing member, the outer fixing member, and the cover do not melt, the inner chassis, the outer chassis, the inner fixing member, and the outer fixing member still close the first through-hole of the door, and the insertion portion of the cover closes gaps between the first and second grooves and the first through-hole of the door, impeding spread of flame or smoke caused by the fire from the one of the inner and outer sides of the door to another of the inner and outer sides of the door, thereby slowing down spread of the fire.

2. The door lock as claimed in claim 1, further comprising:

an outer spindle including an outer driving lug, wherein the outer chassis includes a first outer end face and a first outer axial hole extending from the first outer end face, wherein the outer chassis further includes an outer chamber extending from another end face of the outer chassis to the first outer axial hole, wherein the outer spindle is pivotably received in the first outer axial hole, wherein the outer driving lug is operatively connected to the retractor, wherein the outer mounting seat includes a second outer end face connected to the first outer end face of the outer chassis;

an outer torsion spring received in the outer chamber and configured to bias the outer spindle;

an inner spindle including an inner driving lug, wherein the inner chassis includes a first inner end face and a first inner axial hole extending from the first inner end face, wherein the inner chassis further includes an inner chamber extending from another end face of the inner chassis to the first inner axial hole, wherein the inner spindle is pivotably received in the first inner axial hole, wherein the inner driving lug is operatively connected to the retractor, wherein the inner mounting seat includes a second inner end face connected to the first inner end face of the inner chassis; and an inner torsion spring received in the inner chamber and configured to bias the inner spindle.

3. The door lock as claimed in claim 2, further comprising a locking control device received in the inner spindle, wherein the locking control device includes a control arm movable along a longitudinal axis of the inner spindle, wherein the first outer axial hole includes an inner periphery having a limiting groove, wherein the outer mounting seat further includes an outer movement groove extending from the second outer end face along a longitudinal axis of the first outer axial hole, wherein the outer spindle and the control arm are coupled to pivot jointly, wherein when the control arm is in the limiting groove, the outer handle is prevented from pivoting, and wherein when the control arm is in the outer movement groove, the outer handle is permitted to pivot.

4. The door lock as claimed in claim 1, further comprising two mounting posts, and two bolts, wherein the two mounting posts are connected to the outer fixing member and face the inner fixing member, wherein the two mounting posts are configured to be received in two connecting holes in the door, wherein the two bolts abut the inner fixing member and engage with the two mounting posts.

5. The door lock as claimed in claim 1, wherein the inner mounting seat and the outer mounting seat are made of a zinc alloy or an aluminum alloy.

* * * * *